United States Patent [19]

Young

[11] Patent Number: 4,772,861

[45] Date of Patent: Sep. 20, 1988

[54] $TE_{20}$ RECTANGULAR TO CROSSED $TE_{20}$ RECTANGULAR MODE CONVERTER FOR $TE_{01}$ CIRCULAR MODE LAUNCHER

[75] Inventor: Lock R. Young, Palm Bay, Fla.

[73] Assignee: Harris Corporation, Melbourne, Fla.

[21] Appl. No.: 26,253

[22] Filed: Mar. 16, 1987

[51] Int. Cl.[4] ..... H01P 1/16

[52] U.S. Cl. ..... 333/21 R; 333/34

[58] Field of Search ..... 333/21 R, 21 A, 137, 333/34

[56] References Cited

U.S. PATENT DOCUMENTS

| | | | |
|---|---|---|---|
| 2,439,285 | 4/1948 | Clapp | 333/21 R |
| 2,825,031 | 2/1958 | Parisi | 333/21 A |
| 2,859,412 | 11/1958 | Marie | 333/21 R |
| 4,620,163 | 10/1986 | Young | 333/21 R |
| 4,628,287 | 12/1986 | Zinger et al. | 333/21 R X |

FOREIGN PATENT DOCUMENTS

| | | | |
|---|---|---|---|
| 1930936 | 1/1970 | Fed. Rep. of Germany | 333/21 R |

*Primary Examiner*—Eugene R. Laroche
*Assistant Examiner*—Benny Lee
*Attorney, Agent, or Firm*—Antonelli, Terry & Wands

[57] ABSTRACT

The middle stage of a Marié-type mode launcher is configured by sliding together a pair of reusable multi-wedge shaped mandrels which, when placed together in the direction of the longitudinal axis of the launcher, form a compound mandrel from which a $TE_{20}$ rectangular to crossed $TE_{20}$ rectangular stage may be electroformed. One mandrel has a first double wedge-shaped section that tapers from a rectangular open end (that joins with the rectangular output end of the first stage) to an edge that is effectively diagonally located between opposing vertices of intersecting surfaces of adjacent pairs of four tapered sections that form the 'X'-shaped open output end of the middle stage. The taper of the first section is a dual taper, in directions parallel with the sides of the rectangular input end of the middle stage. The second mandrel is comprised of four symmetrically arranged multi-tapered finger sections each of which has a rectangularly-shaped open output end from three sides of which extend planar surfaces respectively tapering effectively to points that are coincident with the longer ones of parallel sides of the open rectangular end of the middle stage.

15 Claims, 6 Drawing Sheets

$TE_{20}$ RECTANGULAR TO CROSSED $TE_{20}$ RECTANGULAR MODE CONVERTER FOR $TE_{01}$ CIRCULAR MODE LAUNCHER

FIELD OF THE INVENTION

The present invention relates to an electromagnetic energy wave launcher and is particularly directed to an improved middle stage of a three stage $TE_{10}$ rectangular to $TE_{01}$ circular waveguide mode launcher, the middle stage converting a $TE_{20}$ rectangular wave to a crossed $TE_{20}$ rectangular wave for application to a $TE_{01}$ circular output stage.

BACKGROUND OF THE INVENTION

The fundamental configuration of a $TE_{10}$ rectangular to $TE_{01}$ circular waveguide mode launcher as developed by P. Marie in 1956 (described in U.S. Pat. No. 2,859,412) is shown in perspective in FIG. 1 as containing three series-coupled stages A, B and C. The first or input stage A, into which a $TE_{10}$ rectangular mode wave is applied via a rectangular-shaped input end 11, is formed as a "folded E-plane tee" for converting a $TE_{10}$ rectangular mode wave to a $TE_{20}$ rectangular mode wave to be emitted at a rectangular shaped output end thereof that feeds section B. Preferably, the first conversion stage A is configured as an improved dual wedge stage as shown in FIG. 2 and described in U.S. Pat. No. 4,620,163 issued Oct. 28, 1986, entitled "$TE_{10}$ Rectangular to $TE_{01}$ Circular Waveguide Mode Launcher", assigned to the Assignee of the present application and the disclosure of which is incorporated by reference herein.

As shown in FIG. 2 and described in the above-referenced patent, the first conversion stage A has a first open-ended wedge-shaped waveguide section 11 which tapers to a vertex 12 at an open output end 13, and a second open-ended wedge-shaped waveguide section 15 which tapers to a vertex 16 at an input end 14. The first wedge-shaped waveguide section 11 is integrally coupled with the second wedge-shaped waveguide section 15 so that the vertex 12 of the first section 11 forms part of an edge of the output end 13 of the second section and the vertex 16 of the second section forms part of an edge of the input end 14 of the first section. Advantageously, with this improved configuration, not only is performance improved but also the input stage is easier to manufacture.

The second or middle stage B of the overall mode launcher configuration employs a $TE_{20}$ rectangular to crossed $TE_{20}$ rectangular mode converter, shown in perspective in FIG. 3, for gradually changing the $TE_{20}$ rectangular mode output wave from stage A at input end 21 to an 'X' configuration at output end 22. For this purpose, input end of middle stage B has a rectangular-shaped opening defined by a pair of parallel top and bottom walls 27 and 28 and parallel sidewalls 29 and 30 into which the $TE_{20}$ rectangular mode wave from stage A is launched. Extending from these walls are four projecting finger portions 23, 24, 25 and 26 which form an "X" cross-section stage, each finger portion being a triangular or tapered waveguide section extending from the parallel sidewalls 29 and 30 at front end 21 of stage B to output end 22 thereof. This rectangular-to-"X" tapering configuration sets up four orthogonally spaced components of the wave to be aligned with a downstream circular waveguide $TE_{01}$ mode of the third or output end stage C, shown in detail in FIG. 4. As illustrated in FIG. 4, the circular waveguide $TE_{01}$ mode is obtained by configuring stage C to have four tapered portions 43, 44, 45 and one not visible in FIG. 4 extending from respective input ends 33, 34, 35 and 36, which are aligned with the four sections 23, 24, 25 and not visible in FIG. 3 of the 'X'-shaped output end of middle stage B. Each of sections 43–46 tapers to an output circular shape, as shown in FIG. 4, so that what is launched from output 50 of section C is a circular $TE_{01}$ mode wave.

A practical problem in manufacturing a conventional Marié launcher is the high cost of making precision mandrels for electroforming the respective stages of the launcher. As described in my above referenced patent, by configuring the front stage A to have a dual integrated wedge-shape, it is possible to eliminate the use of a costly impedance matching element and simplify the manufacturing process. Unfortunately, the high manufacturing cost is not limited to the formation of the first stage A. The second or middle stage B has a highly complex surface and changing cross-sectional shape that has required the use of a precisely machined mandrel which must be destroyed in the course of its removal from the electroplated stage. Consequently, the cost of manufacture is undesirably exorbitant as a separate mandrel is required for each stage.

SUMMARY OF THE INVENTION

In accordance with the present invention, the undesirably high cost of manufacture of the middle stage of a Marié-configured mode launcher is substantially reduced by modifying the configuration of the middle stage so that it may be produced by interfitting or sliding together a pair of reusable multi-wedge shaped mandrels which, when placed together in the direction of the longitudinal axis of the launcher, form a compound mandrel from which a $TE_{20}$ rectangular to crossed $TE_{20}$ rectangular stage may be electroformed. The surface configuration of the resulting middle stage differs from that of a conventional middle stage of a Marié type launcher in several respects, yet the input and output openings have the requisite rectangular and 'X'-shapes, described above.

More particularly, the new middle stage configuration in accordance with the present invention has a first double wedge-shaped section that tapers from a rectangular open end (that joins with the rectangular output end of the first stage) to an edge that is effectively diagonally located between opposing vertices of intersecting surfaces of adjacent pairs of four tapered sections that form the 'X'-shaped open output end of the middle stage. The taper of the first section is a dual taper, in directions parallel with the sides of the rectangular input end of the middle stage. Namely, from each edge of the rectangular open end of the first section there extends a planar surface that forms an acute angle with a plane containing the four sides of the rectangular open end of the first section. The extensions of these four planar surfaces intersect at the edge mentioned supra at the output end of the middle stage.

The second section of the middle stage is comprised of four symmetrically arranged multi-tapered finger sections each of which has a rectangularly-shaped open output end from three sides of which extend planar surfaces respectively tapering effectively to points that are coincident with the longer ones of parallel sides of the open rectangular end of the middle stage. Specifically, first and second adjacent finger sections of the four symmetrically arrayed multitapered finger sections taper to a first common point at the center of one of the long parallel sides of the open rectangular end of the middle stage, while third and fourth adjacent ones of the finger sections taper to a second common point at the center of the other of the longer parallel sides of the open rectangular end of the middle stage. Each of the four finger sections is offset from its two adjacent finger sections by 90°. The first and second finger sections have respective surfaces that intersect one another at a first interior vertex of the 'X'-shaped open end of the middle stage and that first intersection extends to the first common point. The third and fourth finger sections have respective surfaces that intersect one another at second interior vertex of the 'X'-shaped open end of the middle stage and that second intersection extends to the second common point. The second and third finger sections have respective surfaces that intersect one another at a third interior vertex of the 'X'-shaped open end of the middle stage. The first and fourth finger sections have respective surfaces that intersect one another at a fourth interior vertex of the 'X'-shaped open end of the middle stage.

The third and fourth interior vertices of the 'X'-shaped output end of the middle stage correspond to the opposing vertices between which the diagonally located edges, formed by an extension of the tapered surface of the first section, extend. From the third interior vertex the intersection of adjacent surfaces of the second finger section and the first dual tapered section extends to the first common point. From the fourth interior vertex, the intersection of adjacent surfaces of the fourth finger section and the dual taper section extends to the second common point. Also, from the fourth interior vertex, the intersection of adjacent surfaces of the first finger section and the dual tapered section extends to the second common point.

Because the configurations of the first and second sections, including the dual tapered surfaces of the first section and the tapered surfaces of the first and second sections of the middle stage of the present invention, are linear tapers converging toward the central axis of the mode launcher rather than diverging toward the outer surface of the mode launcher of the conventional Marié configuration, it is possible to form a respective simple two piece reusable electroforming mandrel for each of the first and second sections. The two mandrels readily fit together along the longitudinal axis of the middle stage such that the surfaces of the two sections come together along the intersections described supra, thereby realizing a rectangular-to-X-shaped rectangular conversion-forming compound mandrel. Upon completion of electroplating the compound mandrel, the two mandrel sections are removed from opposite ends of the electroformed middle stage, ready to be replaced together for electroforming another $TE_{20}$ rectangular to crossed $TE_{20}$ rectangular waveguide stage.

DETAILED DESCRIPTION

Referring now to FIGS. 5–10, there are shown respective perspective (FIG. 5), multiple end (FIGS. 6, 7, 8), side (FIG. 9) and top views (FIG. 10) of the improved middle stage B of a Marié type $TE_{10}$ rectangular to $TE_{01}$ circular waveguide mode launcher according to the present invention. Specifically, these Figures show an improved $TE_{20}$ rectangular-to-crossed $TE_{20}$ rectangular stage B.

Figure 1:
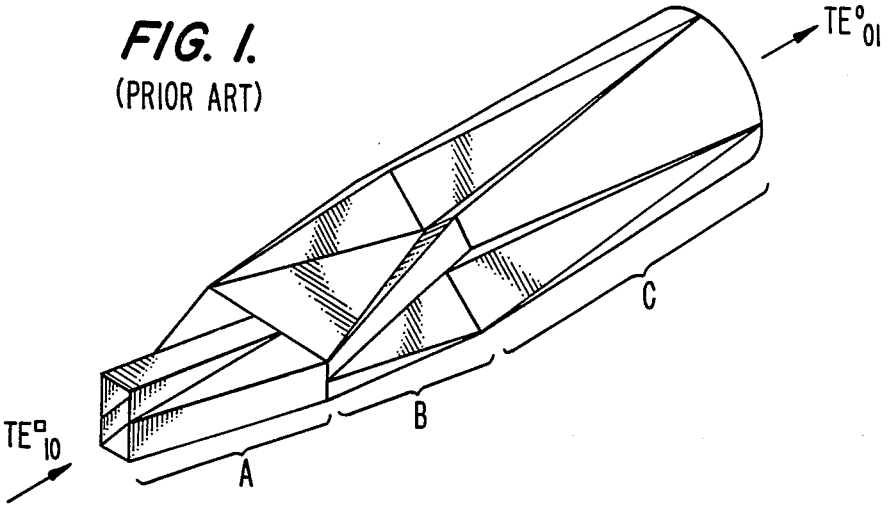
FIG. 1. (PRIOR ART)
FIG. 1 is an illustration of a conventional Marié multi-stage $TE_{10}$ rectangular to $TE_{01}$ circular waveguide mode electromagnetic-wave launcher.
Figure 2:
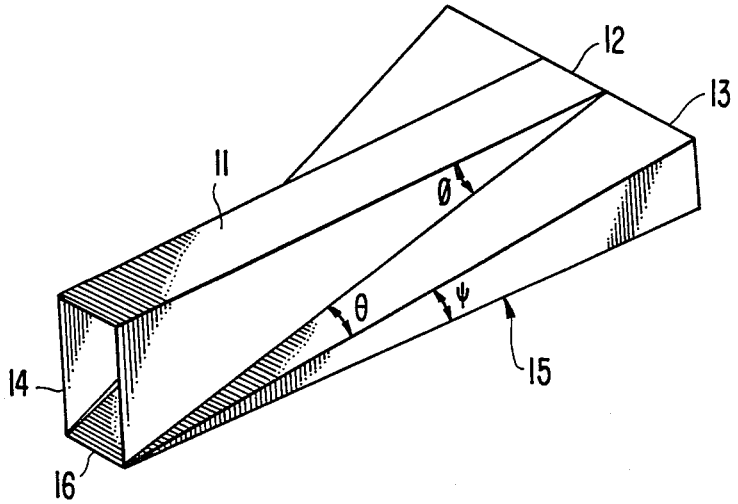
FIG. 2. (PRIOR ART)
FIG. 2 is a perspective view of the input stage A mode launcher as described in U.S. Pat. No. 4,620,163 which may be employed as the input stage of a modified Marie launcher shown in FIG. 1.

As shown in these Figures, the middle $TE_{20}$ rectangular, to crossed $TE_{20}$ rectangular conversion stage B of the Marié type mode launcher of FIG. 1 is comprised of a first multiple tapered wedge section comprised of a rectangular-shaped open end 60 defined by the end edges 61–64 of respective planar conductive walls 71–74. Each of walls 71 and 73 forms a sidewall terminating at opposite parallel edges 61 and 63 of rectangular opening 60 and being oriented at an acute angle $\Phi$ relative to opposite parallel edges 62 and 64 of respective lower and upperwalls 72 and 74 and defines, with wall termination edges 61 and 63, the perimeter of rectangular opening 60. Sidewalls 71 and 73 extend from opening 60 to an imaginary edge 110 (shown in particular in FIG. 6) which is defined between respective vertices 109 and 119 of the X-shaped opening at the output end of the stage B (see FIG. 6). Lower wall 72 and upper wall 74 intersect an imaginary edge 110 and form an acute angle $\theta$. Each of lower wall 72 and upper wall 74 is displaced at an angle $\theta/2$ about an imaginary center plane 70 which symmetrically bisects upper and lower halves of the stage B.

Each of the lower front edge 62 and the upper front edge 64 of the rectangular opening 60 of the $TE_{20}$ rectangular to crossed rectangular $TE_{20}$ conversion stage B of the present invention has a center point 66, 65, respectively equidistant from the ends thereof terminating at sidewall end edges 61 and 63. From center point 65 at upper edge 64 on surface 74, a pair of dual tapered finger sections 81 and 82, offset from one another by 90 degrees angle and oriented at a 45 degrees angle with respect to surface 74, extend from a vertex at center point 65 to rectangular openings 94 and 104.

Figure 6:
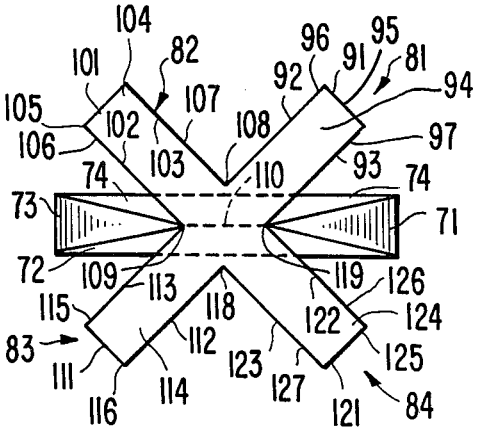
FIG. 6 is a diagrammatic end view of the improved middle stage B of the mode launcher in accordance with the present invention.
Figure 7:
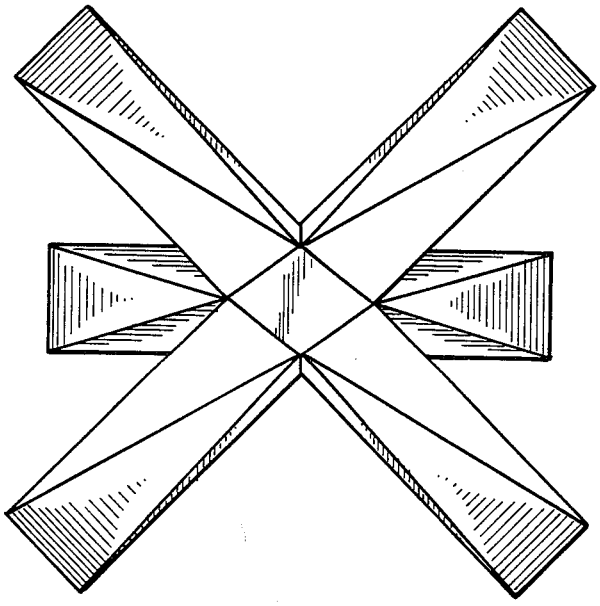
FIGS. 7 and 8 are respective end views of the output end and input end of middle stage B mode launcher in accordance with the present invention.
Figure 8:
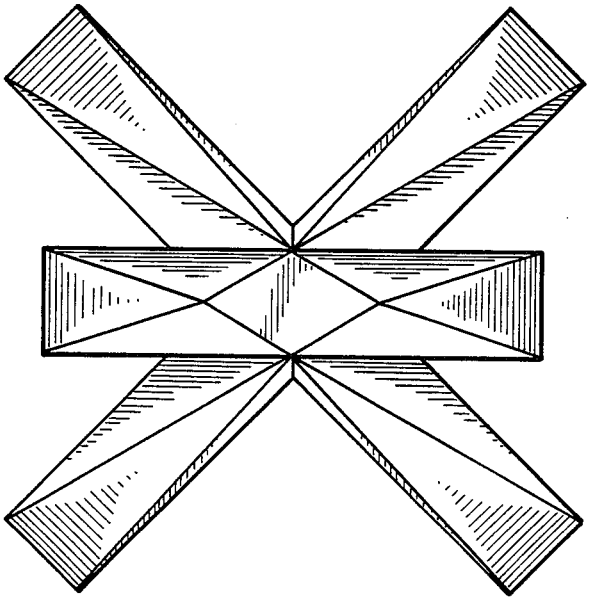

Similarly, from the point 66 at lower front edge 62 of opening 60 dual tapered finger portions 83 and 84 extend to form an X-shaped opening at the output end of stage B, as shown diagrammatically in FIG. 6 and with greater clarity in FIGS. 7 and 8. It is to be noted that reference numerals have been omitted from FIGS. 7 and 8 to show the configuration of the outer and inner surfaces of the $TE_{20}$ rectangular-to-crossed rectangular $TE_{20}$ conversion stage of the present invention. The shading in each of FIGS. 7 and 8 is employed to highlight the outer surfaces of the conversion stage as viewed from the respective output and input ends of middle stage B.

Figure 5:
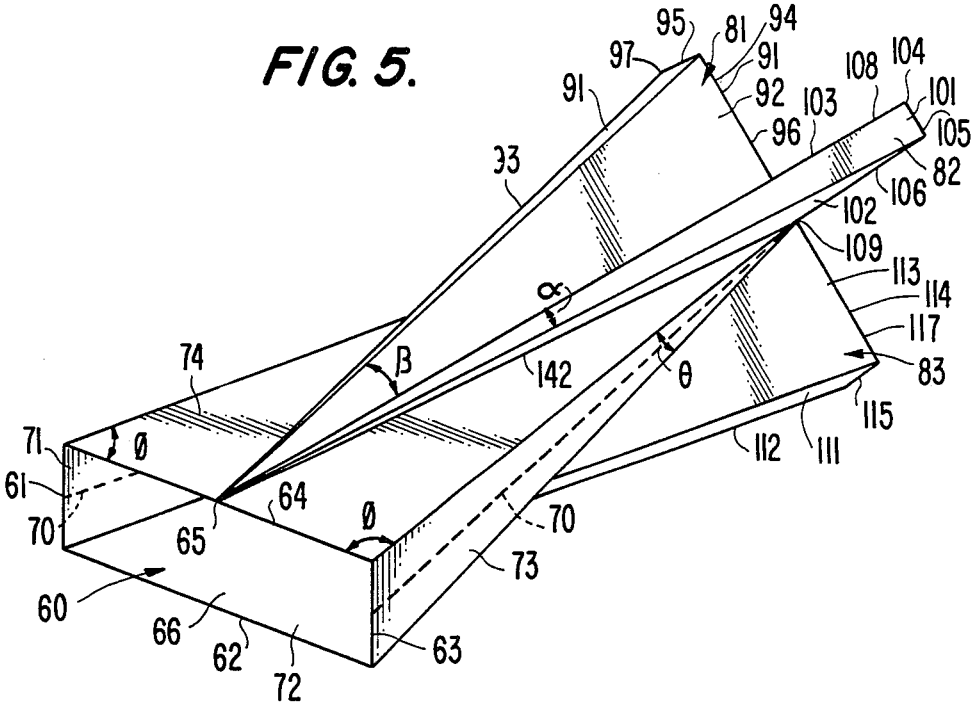
FIG. 5 is a perspective view of an improved middle stage B of a Marié type mode launcher in accordance with the present invention.
Figure 9:
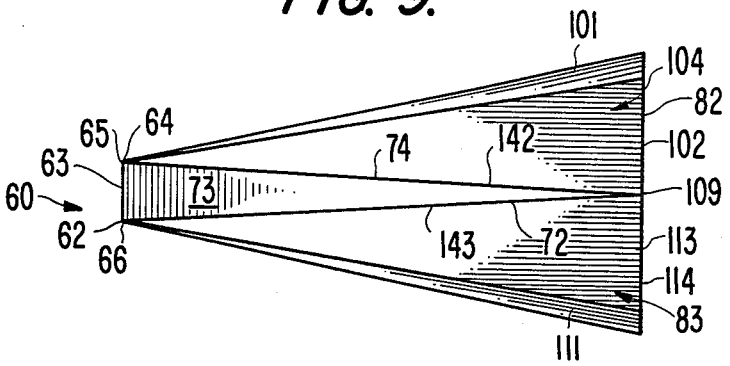
FIGS. 9 and 10 are respective side and top views of the improved middle stage B of the mode launcher in accordance with the present invention.
Figure 10:
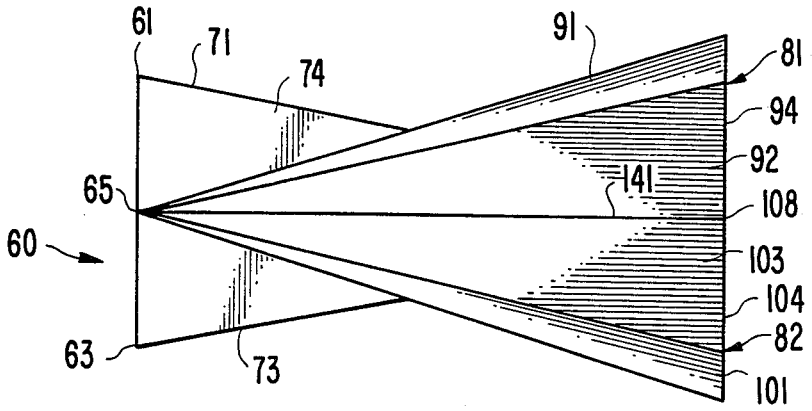

As shown in perspective in FIG. 5 and in the respective end, side and top views of FIGS. 6, 9 and 10, the X-shaped rectangular opening of the output end of the conversion stage is formed by the side walls and top walls of each of finger portions 81–84. Finger section 81 has an opening 94 defined by three walls consisting of side walls 92 and 93 and a wedge-shaped top wall 91 which intersects the top edges of side walls 92 and 93. Top wall 91 and the other top walls 101 and 111 and 121 extend to one of the vertices 65 and 66 (here wall 91 extends to vertex 65), and the sides thereof, which define the sides of sidewalls 92 and 93, converge at center point 65 at an angle $\alpha$. Similarly, sidewalls 92 and 93 extend from the respective parallel end edges 96 and 97 which form, together with end edge 94 and top wall 91, a partially rectangular opening 94 of finger section 81, and converge at an angle $\beta$ at a common end point 65.

In a similar manner, open ended finger section 82, which is adjacent to each of open ended finger sections 81 and 83, is defined by a top wall 101 and a pair of side walls 102 and 103. Top wall 101 extends from an end edge 105 which is effectively perpendicular with each of end edges 106 and 107 of side walls 102 and 103, respectively, and forms therewith a dual tapered wedge (defined by angles $\alpha$ and $\beta$ as mentioned above in connection with the description of open ended finger section 81), and converges at common end point 65 with the top wall 91 and the side walls 92 and 93 of open ended finger section 81. Side wall 92 of section 81 and sidewall 103 of finger section 82 intersect one another at a vertex 108 at the open end of the converter stage and form an intersection line 141, as shown in FIG. 10 between vertex 108 and end point 65. Also, sidewall 102 of open ended finger section 82 forms an intersection line 142 with top surface 74, while sidewall 113 of open ended finger section 83 forms an intersection 143 with bottom wall 72 as shown in the side view of FIG. 9, each of intersections 142 and 143 extending from vertex 109 to respective center points 65 and 66 on upper surface 74 and lower surface 72 of the dual tapered wedge section of the conversion stage.

Open-ended finger section 83 has a pair of side walls 112 and 113 which end from parallel end edges 115 and 116 at the open end of the converter stage and converge at an angle $\alpha$ at center point 66 at the front end of the bottom wall 72. Top wall 111 of open ended finger section 83 is tapered at an angle $\alpha$ like top walls 91 and 101 of respective open ended finger stages 81 and 82 and converges at front edge center point 66 at lower surface 72.

Open ended finger section 84 has a tapered top wall 121 which extends from linear edge 125 and tapers at an angle $\alpha$ to the lower center point 66 at the center of the front lower edge 62 of lower surface 72. Side walls 122 and 123 are tapered at an angle $\beta$ and extend from parallel end edges 126 and 127 which define, with end edge 125 three of the sides of an effectively rectangular opening of one of the portions of the X of the X-shaped opening at the end of the conversion stage. Side walls 122 and 123 intersect lower front edge center point 66.

End edge 116 of side wall 112 of open ended finger section 83 forms a vertex 118 with end edge 127 of side wall 123 of open ended finger section 84. End edge 126 of side wall 122 of finger section 84 forms a vertex 119 with end edge 97 of side wall 93 of open ended finger section 81. As shown in FIG. 6, the respective vertices 108, 109, 118, 119 formed by the intersections of the end edges of the side walls of the open ended finger sections define the minimum cross-sectional opening at the interior portion of the output end of the converter stage of the present invention. As described above, side wall 73 tapers at an angle $\theta$ to vertex 109. Side wall 71 also tapers at an angle $\theta$ to vertex 119.

Figure 3:
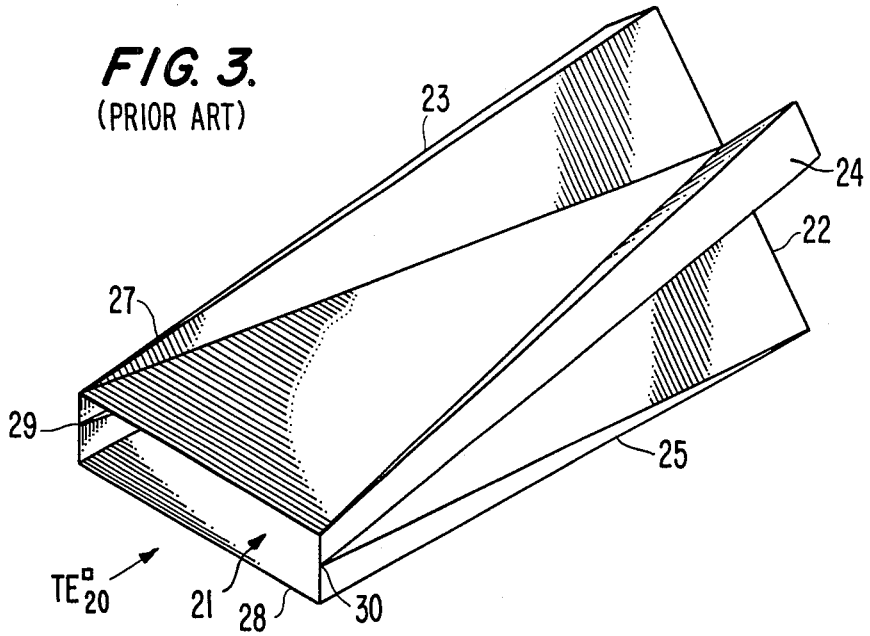
FIG. 3. (PRIOR ART)
FIG. 3 is a perspective view of the second stage B of the mode launcher shown in FIG. 1.
Figure 4:
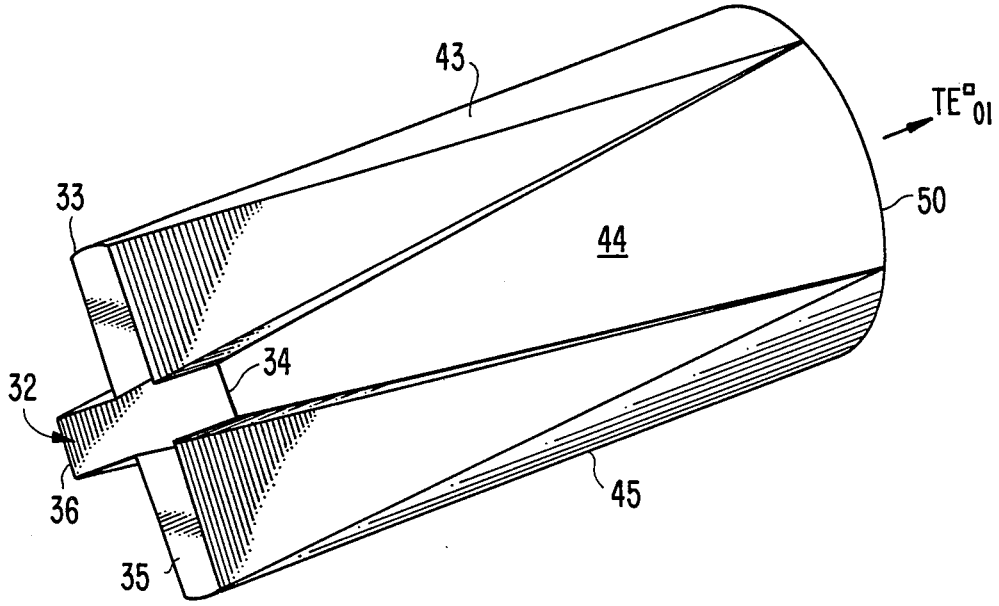
FIG. 4. (PRIOR ART)
FIG. 4 is a perspective view of the third stage C of the mode launcher s own in FIG. 1.

As can be seen from a comparison of FIGS. 3 and 5, each of the $TE_{20}$ rectangular-to-crossed $TE_{20}$ rectangular conversion stages of the prior art and the present invention, respectively, has a rectangular input opening to which the $TE_{20}$ rectangular wave from the input stage B is applied and a X-shaped output opening from which the crossed $TE_{20}$ rectangular mode wave is extracted for application to output stage C. However, unlike the prior art, the respective open-ended finger portions of the present invention taper to a pair of vertices at the centers of the end edges of parallel opposite surfaces which define the open end of the conversion stage, as opposed to adjacent edge portions, as shown at 29 and 30.

In addition, the present invention overcomes the inability of the conventional Marié configuration to be formed with simple reusable mendrels, since the openings at the ends of the section are smaller than the mandrel to be removed. In accordance with the present invention, however, two, easily extractable mandrels for the dual tapered wedge section and the multifingered open ended section, shown in FIGS. 11 and 12, respectively, may be employed.

Figure 11:
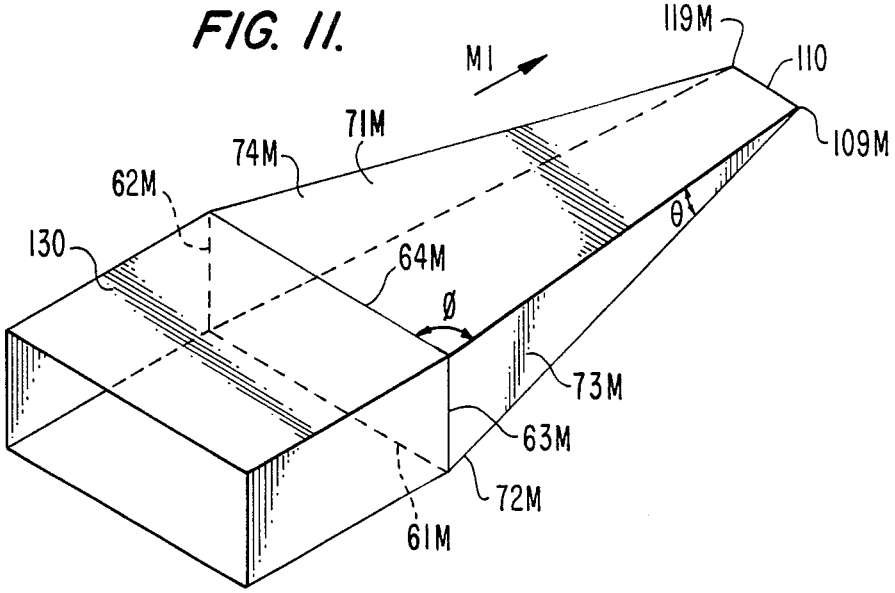
FIG. 11 is a perspective view of a dual tapered wedge-shaped mandrel for forming a first section of the middle stage B shown in FIG. 5.

As shown in FIG. 11, a dual tapered wedge-shaped mandrel has a gripping block 130 from which extend upper and lower tapered surfaces 74M in 72M, corresponding to the intended shape of surfaces 74 and 72 and the embodiment of the invention shown in FIG. 5 and which taper from parallel edges 64M and 62M to a front edge 110 and define an acute angle $\theta$ therebetween. The mandrel also includes respective side surfaces 71M and 73M which extend from parallel side edges 62M and 63M, respectively, and are tapered at an angle $\Phi$ relative to edges 64M and 61M and extend to and join with upper and lower surfaces 74M and 72M to define front edge 110 between vertices 109M and 119M.

Figure 12:
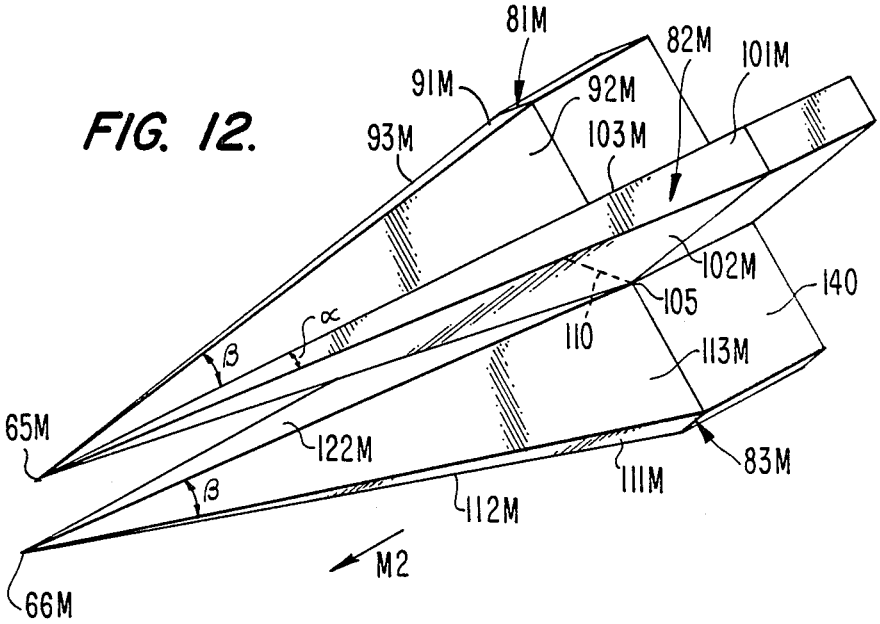
FIG. 12 is a perspective view of a mandrel for forming a multi-tapered X-shaped multi-fingered section of the improved stage B of the mode launcher shown in FIG. 5.

FIG. 12 shows a second mandrel having a X-shaped gripping block 140 from which extend respective dual-tapered fingers 81M, 82M, 83M and 84M, respectively offset from another by 90° and tapering to respective vertices 65M and 66M, as shown. Finger 81M is defined be tapering top wall 91M and tapering sidewalls 92M, 93M. Finger 82M is defined by tapering top wall 101M and tapering sidewalls 102M, 103M. Finger 83M is defined by tapering top wall 111M and tapering sidewalls 112M, 113M. Finger 84M is defined by a tapering top wall (not shown) and a pair of tapering sidewalls, only one which 122M is shown, for purposes of clarity. Vertex 65M corresponds to the center point 65 of the rectangular-crossed-rectangular converter stage shown in FIG. 5 while vertex 66M corresponds to center point 66 on the lower surface 72 thereof. The respective top and side walls of the finger portions 81M . . . 84M are designated with the same reference numerals but with the appendix M for designating a mandrel (M).

As will be appreciated from an examination of FIGS. 11, and 12 and a comparison thereof with FIG. 5, when the mandrel shown in FIG. 11 is inserted along the direction of the arrow M1 which is equally and oppositely oriented with respect to the arrow M2 representing the direction of relative movement of the mandrel shown in FIG. 12, upper surface 74M and lower surface 72M of the mandrel shown in FIG. 11 slide within the opening provided between vertices 65M and 66M and end edge 110, so that when fully inserted into one another, the mandrel (absent gripping blocks 130 and 140) takes on the shape shown in FIG. 5, corresponding to the desired configuration of Stage B.

With the two mandrels inserted together as described above and held in the position to maintain the configuration of the intended shape shown in FIG. 5, the middle stage of the mode launcher is electroformed in a conventional fashion. Each of the mandrels shown in FIGS. 11 and 12 may be made of precision machined stainless steel which interlock along a plane 70 described above with reference to FIG. 5. When the electroforming process is completed, the stainless steel mandrels are then removed from the opposite rectangular and crossed-rectangular ends, namely the input and output ends of the middle stage, so that the middle section may be flanged or soldered together with the input stage A and output stage C to form the complete mode launcher. The mandrels are then available for reuse.

As will be appreciated from the foregoing description, the present invention provides a practical (reuseable) mechanism for reducing the cost of manufacture of the middle stage of a Marié multi-wedge shaped mandrels. When placed together in the direction of the longitudinal axis of the launcher the mandrels form a compound structure through which a $TE_{20}$ rectangular stage may be electroformed. Although the resulting surface configuration differs from that of a conventional Marié middle stage, the input and output openings have the necessary mode interface shapes so that the sought-after transition is achieved.

It is also to be observed that the third section of the launcher can be electrformed integrally with the second section by including its mandrel as part of the second mandrel instead of gripping block 140. Thus, the overall mode launcher can be made in only two pieces flanged at the rectangular $TE_{20}$ junctions. If bends are to be made in long waveguide runs, instead of two complete mode launchers connected by a bent $TE_{10}$ rectangular piece, two partial mode launchers connected by a bent $TE_{20}$ rectangular piece can be used,thereby saving both cost and insertion loss.

While I have shown and described an embodiment in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed:

1. For use in an electromagnetic wave launcher, a device for converting a $TE_{20}$ rectangular mode wave to a crossed $TE_{20}$ rectangular mode wave comprising:

a first, open-ended wedge-shaped waveguide section having an open input end of a rectangular cross-section to which a $TE_{20}$ rectangular mode wave is to be applied. said wedge-shaped slaped waveguide section tapering to a plurality of vertices at an open end of said device, and being, formed of a top wall, a bottom wall and first and second tapered sidewalls which extend between said top said bottom wall are integral therewith to define the open input end of rectangular cross-section; and a second, open-ended, cross-shaped waveguide section having an open output end of X-shaped cross-section from which a crossed $TE_{20}$ rectangular mode wave is to be output, the X-shaped cross-section being integrally coupled with said first open-ended, wedge-shaped waveguide section, so that a respective vertex of said first waveguide section at the open output end of said device is located at a respective interior vertex portion of the X-shaped cross-section of the open output end of said second waveguide section, said second waveguide section being comprised of four wedge-shaped waveguide finger sections which extend from said X-shaped cross-section of the open output end of said second section and taper to vertices at central portions of opposite sides of the rectangular cross-section of the open input end of said first waveguide section.

2. A device according to claim 1, wherein each of said four wedge-shaped waveguide finger sections is formed of a top wall and first and second tapered sidewalls which extend from said top wall and intersect said first waveguide section.

3. A device according to claim 2, wherein each top wall is tapered from the output end of said device to a respective vertex at the open input end of said device.

4. A device according to claim 1, wherein first sidewalls of adjacent ones of respective pairs of said four wedge-shaped waveguide finger sections intersect one another to form respective sidewall intersections which extend to central portions of opposite sides of the rectangular cross-section of the open input end of said first waveguide section.

5. A device according to claim 4, wherein second sidewalls of adjacent ones of respective pairs of said four wedge-shaped waveguide finger sections intersect one of the top and bottom walls of said first waveguide section to form intersections which extend to central portions of opposite sides of the rectangular cross-section of the input end of said first waveguide section.

6. A device according to claim 1, wherein the top wall of said first waveguide section is comprised of first and second top wall portions tapering from open input end of rectangular cross-section to respective vertices at the open output end of said device.

7. A device according to claim 6, wherein the bottom wall of said first waveguide second is comprised of first and second wall portions tapering from said open input end of rectangular cross-section to respective vertices at the open output end of said device.

8. A device according to claim 7, wherein said first top wall portion and said first bottom wall portion taper to a first vertex and said second top wall portion and said second bottom wall portion taper to a second vertex at the open output end of said device.

9. A device according to claim 1, wherein each of said top wall and bottom wall said first waveguide section is tapered from said open input end of rectangular cross-section to vertires at the open output end of said device.

10. For use in a $TE_{10}$ rectangular mode to $TE_{01}$ circular mode electromagnetic wave launcher having an input stage for converting a $TE_{10}$ rectangular mode wave to a $TE_{20}$ rectangular mode wave and an output stage for converting a $TE_{20}$ rectangular mode wave to a $TE_{01}$ circular mode wave, a stage for converting a $TE_{20}$ rectangular mode wave to a crossed $TE_{20}$ rectangular mode wave comprising:

a first open-ended waveguide section having top and bottom walls and first and second sidewalls integral therewith which taper from an open input end to which a $TE_{20}$ rectangular mode wave is to be applied to a plurality of vertices at an open output end of said stage; and a second, open-ended cross-shaped waveguide having an open output end of X-shaped cross-section from which a crossed $TE_{20}$ rectangular mode wave is to be derived, the X-shaped waveguide section comprising four tapered waveguide finger sections, each of which finger sections is integrally coupled with a wall of said first waveguide section and has a top wall and first and second sidewalls integral therewith tapering from the open output end of said stage to a respective vertex at a central portion of one of opposite sides of the rectangular cross-section of the open input end of said first waveguide section.

11. A conversion stage according to claim 10, wherein the top wall of said first waveguide section is comprised of first and second top wall portions tapering from open input end of rectangular cross-section to respective vertices at the open output end of said device.

12. A device according to claim 11, wherein the bottom wall of said first waveguide section is comprised of first and second wall portions tapering from said open input end of rectangular cross-section to respective vertices at the open output end of said device.

13. A device according to claim 12, wherein said first top wall portion and said first bottom wall portion taper to a first vertex and said second top wall portion and said second bottom wall portion taper to a second vertex at the open output end of said device.

14. A device according to claim 13, wherein first sidewalls of adjacent ones of respective pairs of said four wedge-shaped waveguide finger section intersect one another to form respective sidewalls intersections which extend to central portions of opposite sides of rectangular cross-section of the open input end of said first waveguide section.

15. A device according to claim 14, wherein second sidewalls of adjacent ones of respective pairs of said four tapered waveguide finger sections intersect one of the top and bottom walls of said first waveguide section for form intersections which extend to central portions of opposite sides of rectengular cross-section of the open input end of said first waveguide section.

* * * * *